United States Patent [19]

Bayard

[11] 4,139,934

[45] Feb. 20, 1979

[54] PROCESS FOR MANUFACTURING FLOATS FOR CONTINUOUS CASTING

[75] Inventor: Robert Bayard, La Ravoire, France

[73] Assignee: Servimetal, Chambery, France

[21] Appl. No.: 849,877

[22] Filed: Nov. 9, 1977

[30] Foreign Application Priority Data

Nov. 18, 1976 [FR] France ..... 76 35445

[51] Int. Cl.[2] ..... B22D 11/126; B22D 11/00

[52] U.S. Cl. ..... 29/527.2; 164/82; 164/411; 164/DIG. 15; 164/437; 29/527.4; 29/527.3; 428/375; 106/38.9; 106/38.3; 106/38.22; 106/38.2

[58] Field of Search ..... 29/527.1, 527.2, 527.3, 29/527.4; 164/69, 70, 76, 262, 82, 437, 438, 439, DIG. 15

[56] References Cited

U.S. PATENT DOCUMENTS

| | | | |
|---|---|---|---|
| 2,891,291 | 6/1959 | Schnake | 164/437 X |
| 3,672,431 | 6/1972 | Bryson | 164/437 X |
| 3,738,419 | 6/1973 | Hartmann et al. | 164/437 |
| 3,752,217 | 8/1973 | Sevier | 164/437 |
| 4,016,924 | 4/1977 | Maier | 164/437 |

FOREIGN PATENT DOCUMENTS

| | | | |
|---|---|---|---|
| 1010790 | 3/1952 | France | 164/DIG. 15 |
| 951360 | 3/1964 | United Kingdom | 164/DIG. 15 |
| 951871 | 3/1964 | United Kingdom | 164/DIG. 15 |

*Primary Examiner*—C. W. Lanham
*Assistant Examiner*—V. K. Rising
*Attorney, Agent, or Firm*—McDougall, Hersh & Scott

[57] ABSTRACT

The invention relates to floats and to a process for manufacturing floats for the continuous casting of metal alloys and particularly aluminum and alloys thereof, said floats being formed by assembling machined parts of compressed panels of alumino-silicate ceramic fibers having a voluminal mass above 0.45 g/cm$^3$, in which the surfaces which come into contact with the molten metal alloy are coated with a suspension of metallic oxides in a mineral hardener.

11 Claims, No Drawings

PROCESS FOR MANUFACTURING FLOATS FOR CONTINUOUS CASTING

The invention relates to floats for the continuous casting of metal alloys and, in particular, of aluminum alloys, and to a new process for manufacturing of same.

The custom of placing an article, known as a float, beneath the nozzle of the feed runner is known and, as its name implies, this article floats on the surface of the molten metal inside the ingot mold. The float has two main functions. Firstly, it regulates the flow of metal and, for this purpose, is provided with a pellet or a cone for blocking the nozzle. As the level of the metal rises, the float rises and the pellet or cone reduces the flow of metal by partially blocking the orifice of the nozzle. Further, it ensures that the hot molten metal is distributed uniformly over the section of the continuously cast plate or billet. For this purpose, the molten metal reaching the center of the float through the nozzle is guided and distributed by a series of slots, holes, or ports in the float. For a long time, the floats have been made of steel. They could be either self-floating, that is to say lighter than the molten aluminum, or balanced by a counter-weight when heavier.

Compressed refractory materials of the marinite type are being used more and more for manufacturing floats. This type of material is manufactured and marketed in the form of plates of varying thicknesses, and the final shape of the floats, generally rectangular in the case of plates and circular in the case of billets, is obtained by machining operations such as turning, milling and assembled by screws, clasps, glue, etc.

Two types of difficulty are encountered when manufacturing floats from marinite. Firstly, marinite is a compressed refractory material having asbestos as one of the raw materials. When machining this material, it is necessary to take a number of precautions to prevent the machinists from inhaling the toxic asbestos. Secondly, the working life of such floats is relatively short, of the order of a score of castings as a maximum. This is caused by the fact that when marinite is used to make floats for casting aluminum or aluminum alloys, the conditions of use stretch to the limit the capacities of this material which can function when continuously exposed to a temperature of about 550° C. with intermittent stages at 700° C. The temperature for casting aluminum alloys is generally of the order of 700° C.

The applicant has found that a more refractory material, generally used for coating chutes, could be used for manufacturing these floats, but that the properties thereof were ill adapted a priori to the manufacture of articles by machining and assembly. These comprise alumino-silicate refractory materials in the form of plates or panels molded from such fibers, as by suction.

These plates or panels are obtained in the following manner: the fibers of alumino-silicate material, in suspension in water, which may contain mineral binder additions, are sucked onto a metallic gauze or a grill. The layers of fibers are firstly deposited on the metallic gauze, with one layer deposited on the other. A sort of non-woven refractory textile material is obtained in which only the face thereof in contact with the metallic gauze has a level and smooth surface. If binder is not added to the water containing the fibers in suspension, a pliable refratory felt is obtained after drying. If the water contains a mineral binder, the material may be delivered moist, either in the form of a pliable cloth or, after drying, with or without compression, in the form of plates or panels of various thicknesses which are slightly rigid but, in general, less rigid than panels formed of marinite.

The density (voluminal mass) of such a material is obviously related to the degree of compression to which the panels have been subjected.

These materials may thus be used for the internal coating of chutes as they have the following advantages for this application:

lightness, high resistance to thermal impacts with maximum temperatures of use of the order of 1260°, excellent thermal insulation, absence of sticking of the aluminum and its alloys in spite of the random orientation of the refractory fibers, owing to the fact that the surface of the panel engaged by the liquid aluminum is the smooth and level surface in contact with the metallic gauze at the time of manufacture.

However, if this product is to be used for manufacturing floats, machining will remove this smooth surface containing well orientated fibers; it will break the fibers and expose the otherwise closed porosity meaning that the fibers on the external surface of such a machined product can easily be grasped with a scraper or even with a finger nail. Such an irregular surface promotes the adhesion of the molten aluminum such that is appears that such a product would not be suitable for use in the manufacture of floats exposed to the chemical and mechanical action of molten aluminum alloys.

It has been found by the applicant that floats could be manufactured of machined plates or panels made of alumino-silicate fibers under two conditions:

(1) By using a panel made of a fibrous material and compressed sufficiently to provide relative cohesion of the different fibers forming the plate. This is translated by a condition of voluminal mass (density) which must be between 0.45 g/cm$^3$ and 1 g/cm$^3$ or even higher and, preferably about 0.5 g/cm$^3$.

(2) By coating the surfaces of the float after machining and assembly with a protective layer formed by a suspension of refractory powder in a mineral hardener such as, for example, a sodium silicate solution. This refractory powder may be a mixture of oxides, for example a mixture of alumina, iron oxide, lime, titanium oxide and sodium oxide, but other similar materials may also be used.

With regard to machining, this product may be worked with a spindle molding machine, a milling machine, a lathe or a drilling machine. The different parts forming the float can be assembled, with screws, glue or clasps.

Although the floats which are manufactured in this way are apparently less rigid than marinite and are more pliable when compressed, they have a long working life.

As an example, two floats used for casting aluminum plates, of the same geometric shape and subjected to the same conditions, one of which is made of marinite and the other of alumino-silicate fibers according to the invention, sustain seventeen castings and forty-five castings respectively. The gain in service life obtained by the invention is therefore significant.

I claim:

1. A process for manufacturing floats for the regulation of the level of molten metal in the continuous casting of the metal comprising assembling the float with parts formed of plates of aluminum silicate fibers in which the plates having a density above 0.45 g/cm$^3$ have been machined to form the parts, coating the machined surfaces of the parts, before or after assembly, with a mixture of a refractory metal oxide in finely divided form and a mineral hardener or binder.

2. A process as claimed in claim 1 in which the metal to be cast is a molten alloy of aluminum.

3. A process as claimed in claim 1 in which the refractory metal oxide is selected from the group consisting of alumina, iron oxides, calcium oxide, titanium oxide, and sodium oxide, and mixtures thereof.

4. A process as claimed in claim 1 in which the mineral hardener is an alkali metal silicate.

5. A process as claimed in claim 1 in which the plate of which the parts are formed has a density within the range of 0.45 to 1 g/cm$^3$.

6. A process as claimed in claim 1 in which the plate of which the parts are formed has a density of about 0.5 g/cm$^3$.

7. A process as claimed in claim 1 in which the protective coating is applied to coat the float.

8. A process as claimed in claim 1 in which the plates of aluminum silicate fibers are formed by suspending the fibers in aqueous medium, straining the suspension through a fine porous surface to separate the fibers on the surface thereof to form one or more non-woven layers of the refractory fibers, and compressing the layer or layers to a density after drying of at least 0.45 g/cm$^3$.

9. A process as claimed in claim 1 in which the density of the layer or layers after drying is within the range of 0.45 to 1 g/cm$^3$.

10. A process as claimed in claim 1 to form a fabric having a smooth surface which was originally in contact with the porous surface.

11. A process as claimed in claim 1 in which the smooth surface is disrupted during the machining operation and the protective coating composition is applied to such surface on the float.

* * * * *